US006402869B1

(12) United States Patent
von Haas

(10) Patent No.: US 6,402,869 B1
(45) Date of Patent: Jun. 11, 2002

(54) METHOD FOR GLUING PLYWOOD AND LVL BOARDS

(75) Inventor: Gernot von Haas, Leimen (DE)

(73) Assignee: Maschinenfabrik J. Dieffenbacher GmbH & Co., Eppingen (DE)

( * ) Notice: Subject to any disclaimer, the term of this patent is extended or adjusted under 35 U.S.C. 154(b) by 0 days.

(21) Appl. No.: 09/562,435

(22) Filed: May 1, 2000

(30) Foreign Application Priority Data

May 1, 1999 (DE) ..... 199 19 823

(51) Int. Cl.[7] ..... B31F 5/04

(52) U.S. Cl. ..... 156/157; 156/325; 156/299; 156/331.7; 156/335; 144/344; 144/380

(58) Field of Search ..... 156/157, 324, 156/325, 326, 327, 328, 329, 330, 330.9, 331.1, 331.2, 331.3, 331.4, 331.5, 331.6, 331.7, 331.8, 331.9, 332, 333, 334, 335, 336, 337, 338, 299; 144/344, 346, 348, 352, 380; 428/106, 151, 292.4, 511, 537.1, 535

(56) References Cited

U.S. PATENT DOCUMENTS 5,772,830 A * 6/1998 Hasegawa ..... 156/292

FOREIGN PATENT DOCUMENTS

DE 197 18 772 11/1998

* cited by examiner

*Primary Examiner*—Sam Chuan Yao
*Assistant Examiner*—Jessica Rossi
(74) *Attorney, Agent, or Firm*—Foley & Lardner

(57) ABSTRACT

The invention relates to a method of gluing veneers to form LVL and plywood boards from veneers laid one over the other in several layers by curing the adhesive placed between the single layers in a heated press. The invention consists in the fact that the gluing and pressing of the outer layers of a veneer pack to form LVL and plywood boards is performed by high-temperature adhesive and the inner layers by low-temperature adhesive, so that the amount of heat to be put into the veneer pack decreases from the outside in.

5 Claims, 1 Drawing Sheet

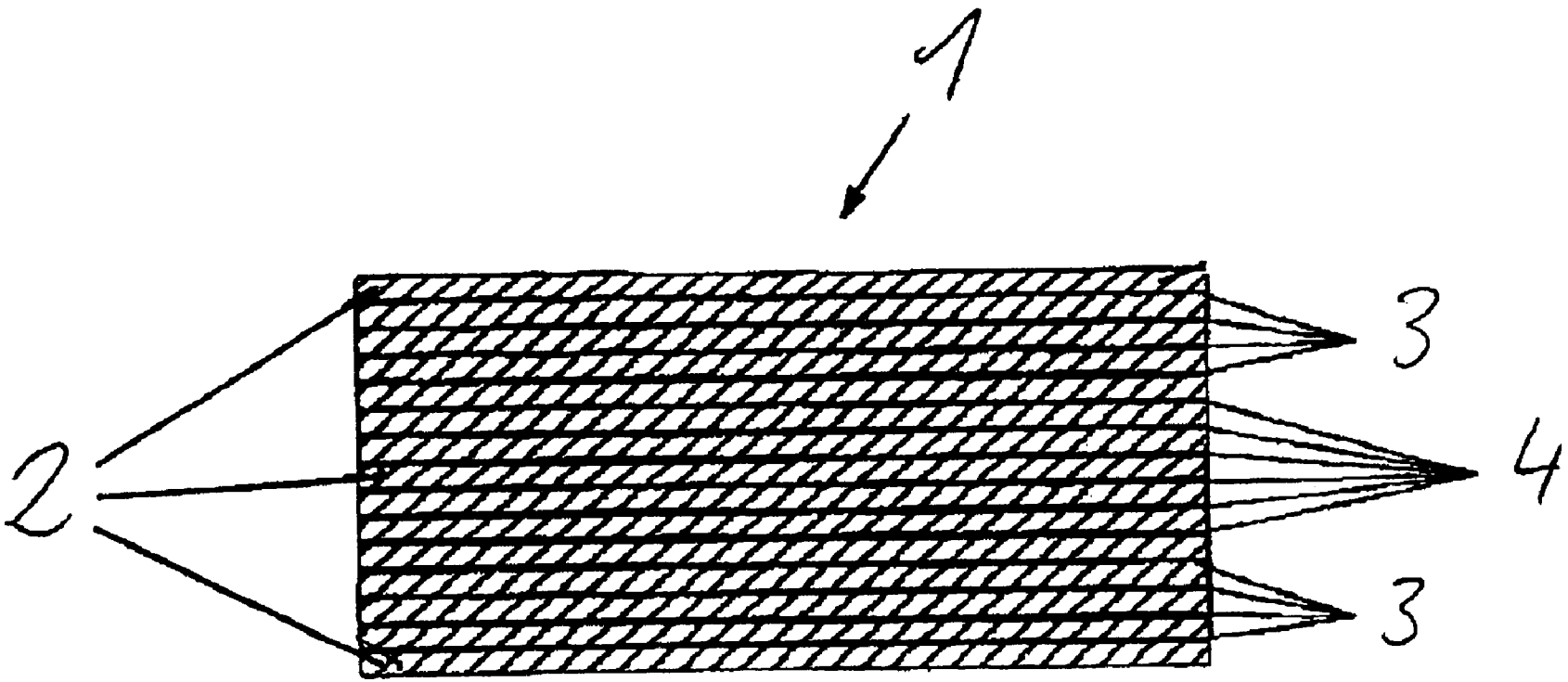
1
2
3
4
3

METHOD FOR GLUING PLYWOOD AND LVL BOARDS

FIELD OF THE INVENTION

The invention relates to a method for gluing plywood and LVL (long veneer lumber) by assembling several layers of veneers one over the other and curing the adhesive placed between the single layers by pressing in a heated press.

BACKGROUND OF THE INVENTION

LVL and plywood boards consist of veneers with thicknesses of 0.5 mm to 6 mm. The veneers are glued, as a rule, with phenol formaldehyde adhesive, assembled together, compressed in a hot press and the glue is cured by the action of heat. Phenol formaldehyde adhesive is a high-temperature glue which, after reaching 110° C. hardens in about 1 minute by condensation reactions. At temperatures lower than 110° C. the condensation reaction takes substantially longer and takes place to only a limited extent. The strength of this glue bond is therefore less than when it is cured above 110° C. If the curing reaction is properly controlled, the phenolic resin glue produces a waterproof and boil-proof bond. The plywood and LVL produced are weatherproof and can be used in construction work. The adhesive is good in comparison to other adhesives with which a weatherproof and boil-proof bond can be achieved. Therefore, for plywood and LVL used in construction work, phenol formaldehyde glue is used almost exclusively.

Plywood and LVL boards are produced as a rule in thicknesses up to 45 mm. The veneers and glue are heated exclusively by conduction in the hot press. The heat passes from the press platens through the outer layers into the inner layers. The heating time, i.e., the time elapsing until 110° C. is reached in the center of the board, increases disproportionately with increasing board thickness due to the poor thermal conductivity of wood. For example, at an initial board temperature of 30° C. and a press platen temperature of 160° C., the heating time for 20 mm thick boards is 5 minutes, for 40 mm thick boards 20 minutes, and for 80 mm thick boards 120 minutes.

In order also to produce boards of thicknesses greater than 45 mm (thick boards) in an economically reasonable time various proposals have been made. Increasing the press platen temperature to above 160° C. has proven disadvantageous because at temperatures higher than 160° C. for periods of over 20 minutes the wood is thermally decomposed. Also the thermal decomposition definitely reduces the strength of the board. In a known discontinuous manufacturing process the boards are heated in single-stage or multi-stage presses by high frequency. The press platens are designed so that they can be heated and used simultaneously as condenser platens. The press platen temperature in this process is about 110° C. The veneers are deposited onto the bottom press platen, compressed, and then heated by high frequency over the entire pad cross section. To operate such an apparatus complicated protective measures are necessary. The press must be shielded. Only certain frequencies can be emitted. Moreover, trained personnel are needed during operation. Since the efficiency of the electric energy is around 50%, this way of heating involves high energy costs. Furthermore, in the case of excessively great veneer moisture content there is the danger of burning through and carbonizing the board. In a continuous manufacturing process heating with high frequency cannot be done since the continuous hot presses cannot be equipped for high-frequency heating.

According to DE 197 18 772, in the continuous manufacturing process the veneers are heated ahead of the hot press by microwave irradiation across the entire cross section of the mat. The production of very thick boards by this method involves some disadvantages. Since the microwave is a few meters ahead of the hot press, premature setting of the adhesive can occur while the veneers are transported on the way from the microwave to the hot press. The adhesive bond is weakened by premature setting. Since the production speed decreases with increasing thickness, such premature setting also increases. In the event of a production halt, this kind of great premature setting of the veneers situated between the microwave and the hot press can occur such that the section of boards is wasted.

Up to a certain temperature and moisture combination the wood is softened as the temperature and moisture increase. With a common veneer moisture content of about 8–10%, the wood definitely softens at temperatures above 100° C., and the softening can increase further up to about 140° C. While the glue is setting the veneers must be subjected to a certain minimum pressure of about 1.5 $N/mm^2$ to achieve full-surface contact. The thickness of the veneers is reduced by the pressure while it is applied (press shrinkage). As the temperature of the veneers increases the press shrinkage increases disproportionately after a temperature above 100° C. The press shrinkage in the normal hot pressing of LVL and plywood boards is about 10%. Press shrinkage is undesirable, as a rule, since more material must be put in for the same order of magnitude. Another problem is that, in the finished board, the compressed veneers spring back due to swelling and shrinking processes. This rebound makes the board irregular in thickness and in extreme cases it must be discarded.

As a disadvantage of the conventional methods it is also to be stated that, during the hot pressing the temperature of the veneers rises to above 100° C., water is evaporated, and an excess steam pressure builds up between the veneers. As the moisture of the veneers increases, the excess steam pressure rises. If the excess steam pressure between the veneers is greater after leaving the press than the strength of the glue bond, the board bursts and becomes waste. This bursting occurs as a rule in the center of the board, since this layer is not heated until the end of the pressing operation and thus receives the briefest curing time and has the lowest strength of adhesion. Also, in the outer layers the steam can flow partially over the surface of the board after it leaves the hot press, so that the steam pressure is reduced in that area.

The invention is addressed to the problem of producing thick LVL or plywood boards economically such that additional heating besides the conductive heating in the hot press by high frequency, for example, or preheating, is no longer necessary.

SUMMARY OF THE INVENTION

The solution of the above described problems consists in the fact that the gluing and pressing of the outer layers of a veneer pack to form LVL or plywood boards is performed by means of high-temperature adhesive and the inner layers by low-temperature adhesive, so that the amount of heat to be put into the veneer pack diminishes from the outside in.

Additional advantageous measures and embodiments of the subject matter of the invention will be found in the subordinate claims and the following description with the drawing.

BRIEF DESCRIPTION OF THE DRAWING

The drawing shows the construction of a veneer pack 1 as it is used in the production of LVL or plywood boards by the method of the invention.

DETAILED DESCRIPTION OF THE PREFERRED EMBODIMENT

The advantage of this process is to be seen in the fact that the production of thick LVL or plywood boards is possible without heating the pack all the way through. The veneers of the board are spread with different adhesives. The veneers of the outer layers are spread with a high-temperature adhesive and the veneers of the inner layers with a low-temperature adhesive.

The press time is chosen so that, after leaving the hot press, the middle of the LVL or plywood board is not heated above 60° C. or at most to 40° C.

Low-temperature adhesive sets at room temperature in about 20 to 60 minutes and, at temperatures around 60° C. it sets in a few minutes. The price of these adhesives per square meter of glue surface amounts approximately to 3 to 6 times that of phenol formaldehyde high-temperature adhesive. Highly reactive polyurethane adhesive has proven to be an especially suitable low-temperature adhesive for gluing veneers. However, melamine formaldehyde adhesives or resorcinol adhesive can also be used. By using low-temperature adhesive the pressing time for thick boards is definitely reduced since heat needs to be put into only the outer layers of the pack consisting of veneers and high-temperature adhesive. Thick boards can now be pressed in about 20 to 30 minutes. Since the inexpensive high-temperature phenol formaldehyde glue is used only in the outer layers of the pack the finished product can be produced at substantially lower cost than when low-temperature adhesives are used exclusively.

The method of the invention provides the additional advantage that in the hot pressing operation only the outer layers are heated and thus the press shrinkage is reduced to about a third of the usual amount. The reduction of press shrinkage saves material and the dimensional accuracy of the board in swelling and shrinking procedures increases.

Another important advantage of the method of the invention is that production safety is definitely increased during the hot pressing.

According to the method of the invention the temperature in the middle of the board during the hot pressing does not rise to 100° C. or more and no excess vapor pressure builds up in the center of the board. Then also, a higher veneer moisture can be present in the pressing operation. The boards have a moisture content that is closer to the equalization moisture. The acclimatization of the boards can thus be shortened, and in the later employment of the boards fewer changes in the board dimensions resulting in waste will occur. Because the boards are not heated all the way through, energy (thermal and electric) is additionally saved.

It can also be advantageous that in the production of especially thick LVL or plywood boards, in building up the veneer pack it is not two but three or more heat-curing glues that are used, graded by their curing temperature from the outside in, that is, from the outer layers to the center of the board.

The drawing shows the construction of a veneer pack 1 as it is used in the production of LVL or plywood boards by the method of the invention. The veneers 2 are laid one on the other in several layers, while the surfaces of the outer veneers are provided with high-temperature glue 3 and the inner veneers with low-temperature glue 4.

The above description and drawing are illustrative only because modifications could be made without departing from the present invention, the scope of which is to be limited only by the following claims.

The priority document here German Application No. DE 199 19 823.3, filed May 1, 1999 (including its specification, drawings, and claims), is hereby incorporated by reference into this application.

What is claimed is:

1. Method for gluing veneers to form LVL and plywood boards of veneers assembled in several layers one over the other and curing adhesives placed between the layers by pressing in a heated press, comprising the steps of:

applying high-temperature adhesive between outer veneer layers of a veneer pack; and applying low-temperature adhesive between inner veneer layers of the veneer pack, whereby an amount of heat required to be put into the veneer pack to cure the adhesives decreases from the outside in.

2. Method according to claim 1, wherein the high-temperature adhesive comprises phenolic resin and the low-temperature adhesive is selected from a group consisting of phenol resorcinol, polyurethane, and melamine formaldehyde.

3. Method according to claim 2, wherein a temperature is raised in a middle of a thickness of the veneer pack to about 60° Celsius.

4. Method according to claim 3, wherein several high-temperature to low-temperature adhesives graded in setting temperature from the outside to the middle of the pack are placed between the veneer layers of the pack.

5. Method according to claim 3, further comprising the step of applying at least one additional adhesive between layers of the veneer pack formed between the outer layers and the inner layers, wherein the at least one additional adhesive has a setting temperature such that a setting temperature range decreases for each subsequent adhesive layer from an outside of the veneer pack to the middle.

* * * * *